US007641332B2

(12) United States Patent
McGaire

(10) Patent No.: US 7,641,332 B2
(45) Date of Patent: Jan. 5, 2010

(54) POST-IMAGING PUNCHING APPARATUS AND METHOD

(75) Inventor: Mark D. McGaire, Surrey (CA)

(73) Assignee: Eastman Kodak Company, Rochester, NY (US)

( * ) Notice: Subject to any disclaimer, the term of this patent is extended or adjusted under 35 U.S.C. 154(b) by 665 days.

(21) Appl. No.: 11/398,295

(22) Filed: Apr. 3, 2006

(65) Prior Publication Data

US 2007/0229638 A1 Oct. 4, 2007

(51) Int. Cl.
*B41J 2/01* (2006.01)

(52) U.S. Cl. ..... 347/104; 347/105; 101/93.07

(58) Field of Classification Search ..... 347/101, 347/104, 105; 101/93.07; 399/274, 284
See application file for complete search history.

(56) References Cited

U.S. PATENT DOCUMENTS 4,833,985 A 5/1989 Kojima et al.
5,255,607 A 10/1993 Nishiyama et al.
5,257,444 A 11/1993 Nishiyama
5,461,980 A 10/1995 Maejima et al.
5,502,993 A 4/1996 Powers et al.
5,511,479 A 4/1996 Rogovein et al.
5,537,927 A 7/1996 Rogovein et al.
5,686,999 A 11/1997 Mizuno et al.
5,826,513 A 10/1998 Fromson et al.
5,865,118 A 2/1999 Fromson et al.
5,889,547 A 3/1999 Rombult et al.
5,915,743 A 6/1999 Palma
6,016,752 A 1/2000 Harari
6,076,464 A 6/2000 Okamura
6,119,556 A 9/2000 Hillier et al.
6,233,038 B1 5/2001 Lennhoff et al.
6,299,572 B1 10/2001 Harari
6,321,651 B1 11/2001 Tice et al.
6,354,208 B1 3/2002 Bos et al.
6,368,263 B1 4/2002 Lynch et al.
6,604,465 B2 8/2003 Tice et al.
6,635,001 B2 10/2003 Lynch et al.
6,652,051 B1 * 11/2003 Kokkas ..... 347/3
6,662,725 B1 12/2003 Koizumi et al.
6,772,691 B2 8/2004 Wolber
6,860,595 B2 * 3/2005 Guerrero Zepeda ..... 347/104
6,899,030 B2 5/2005 Fowlkes et al.
6,917,413 B2 7/2005 Hashiguchi
6,945,645 B2 * 9/2005 Baron ..... 347/104
6,955,350 B2 10/2005 Hashiguchi et al.
6,968,782 B2 11/2005 Cummings
6,972,833 B2 12/2005 Hashiguchi
2002/0062164 A1 5/2002 Lynch et al.

(Continued)

FOREIGN PATENT DOCUMENTS

JP 2001265003 3/2003

(Continued)

*Primary Examiner*—Lamson D Nguyen
(74) *Attorney, Agent, or Firm*—Donna P. Suchy

(57) ABSTRACT

An imaging and punching system and related method for a plate imaging system that can record an image on recordable media and punch the imaged media. The imaging and punching system includes a punching apparatus that is a part of the imaging and punching system that can precisely punch an imaged plate in a punch area. The system also includes a transfer assembly, including the imaged media support, having a pivot for moving the imaged media from the imaging system to the punching system. The pivot having a fixed relationship to said imaging system and said punching system and movable about the pivot between a first position proximate the imaging system and a second position proximate the punching system.

17 Claims, 8 Drawing Sheets

U.S. PATENT DOCUMENTS

| | | | |
|---|---|---|---|
| 2003/0036468 | A1 | 2/2003 | Blank et al. |
| 2003/0184823 | A1 | 10/2003 | Kan et al. |
| 2004/0189974 | A1 | 9/2004 | Hashiguchi |
| 2005/0056168 | A1 | 3/2005 | Tamura et al. |

FOREIGN PATENT DOCUMENTS

| | | |
|---|---|---|
| JP | 2003270796 | 9/2003 |
| JP | 2005041123 | 2/2005 |

* cited by examiner

POST-IMAGING PUNCHING APPARATUS AND METHOD

CROSS REFERENCE TO RELATED APPLICATIONS

Reference is made to commonly assigned U.S. patent application Ser. No. 11/397,037 filed Apr. 3, 2006, entitled "Punching Debris Extraction System", by Mark D. McGaire, et. al.; commonly assigned U.S. patent application Ser. No. 11/397,035 filed Apr. 3, 2006, entitled "IMAGING AND PUNCHING THERMAL CONTROL SYSTEM", by Mark D. McGaire; and commonly assigned U.S. patent application Ser. No. 11/396,516 filed Apr. 3, 2006, entitled "Plate Processing System and Method", by Mark D. McGaire.

FIELD OF THE INVENTION

This invention relates in general to an imaging and punching apparatus and related method for a plate imaging system. More particularly, it relates to a punching apparatus that is a part of the imaging and punching system that can precisely punch an imaged plate.

BACKGROUND OF THE INVENTION

Printing plates typically include an image area that is either capable of forming or not forming a printed imaged when the plate is mounted on a press cylinder of a printing press. The images are formed on the printing plate by one of many methods known in the art including directly imaging the image on the printing plate Typically, multiple printing plates are used in a printing operation, wherein each plate prints a specific color on the printed substrate. Each plate is registered to its corresponding press cylinder via one or more features punched in the plate.

Current plate imaging and punching systems are separated from each other or made in a way that can make it difficult to punch a plate accurately. One way that has been used to overcome this problem and ensure that the plate is in the correct position when it is punched is to mark the plate where it is to be punched. Others pre-punch their plates but this may have the disadvantage of not being able to fit in the available space and therefore complicating the architecture of the machine. Still others have staggered their punch registration pins so that larger plates can not contact the same pins as smaller plates do, but this may have the disadvantage that if both small and large plate use the same punch holes, one can not use fixed position punches (i.e. the punches would have to move into the plate direction to compensate for the amount of stagger the pins have). Many of these methods of punching a plate also cause damage to the plate.

There is a need for an improved apparatus and method to image and punch recordable media such as printing plates.

SUMMARY OF THE INVENTION

An apparatus and method for imaging and perforating recordable media including an imaging system for imparting an image on the recordable media to form an imaged media; a perforation assembly adjacent the imaging system including at least one perforation device having a punch movable into and out of a punch area to punch the imaged media. The system also includes a transfer assembly, including the imaged media support, having a pivot for moving the imaged media from the imaging system to the perforation device. The pivot having a fixed relationship to said imaging system and said punching system and movable about the pivot between a first position proximate the imaging system and a second position proximate the punch area.

BRIEF DESCRIPTION OF THE DRAWINGS

The invention and its objects and advantages will become apparent upon reading the following detailed description and upon reference to the drawings, in which.

DETAILED DESCRIPTION OF THE INVENTION

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention, as defined by the appended claims.

Figure 1:
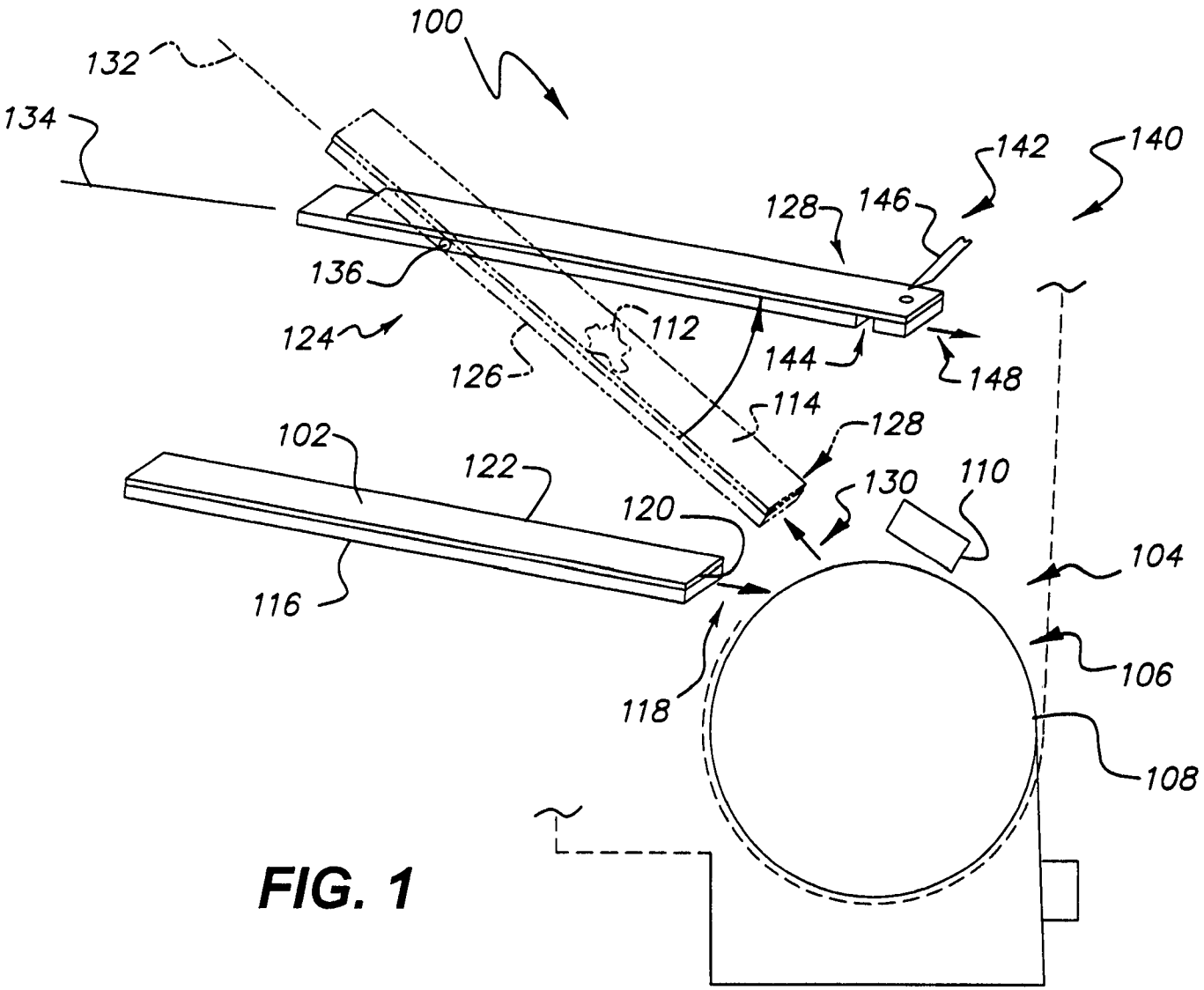
FIG. 1 is a schematic illustration of an imaging and punching system.

Referring now to FIG. 1, an imaging and punching system 100, including an apparatus and method, for imaging and perforating recordable media 102 using an imaging system 104. The imaging system 104 includes an image-recording device 106 with an image-recording member 108, which in a preferred embodiment is a drum, and an exposure head 110. The image-recording device 106 is capable of recording an image 112 on the recordable media 102, such as a plate, to form an imaged media 114. The exposure head accomplishes this in the preferred embodiment by translating along the sub-scanning axis of the drum while the drum is rotating. One edge of the plate is located with a thickness-detecting laser before the drum starts to spin. There are other methods for determining where the edge of the plate is prior to recording the image, as known by those skilled in the art.

The imaging system 104 also includes a recordable media support 116 for conveying the recordable media 102 to the imaging system wherein the recordable media support 116 and the image-recording device 106 defines a load path 118. In one preferred embodiment the image 112 is aligned relative to at least two edges 120, 122 of the recordable media as will be discussed in more detail below.

A transfer assembly 124, including an imaged media support 126 with a movable first end 128 to accept the imaged media 114 via an unload path 130 wherein the imaged media support 126 and the image-recording device 106 define the unload path 130. The first end 128 disposed to shuttle between a first position 132, indicated by the dashed lines, and a second position 134, indicated by the dashed lines. The imaged media 114 is unloaded from the imaging system 104 onto the imaged media support 126 when the first end 128 is in the first position 132 and the imaged media 114 is loaded from the imaged media support 126 surface to a punching system 140 when the first end 128 is in the second position 134.

Figure 3:
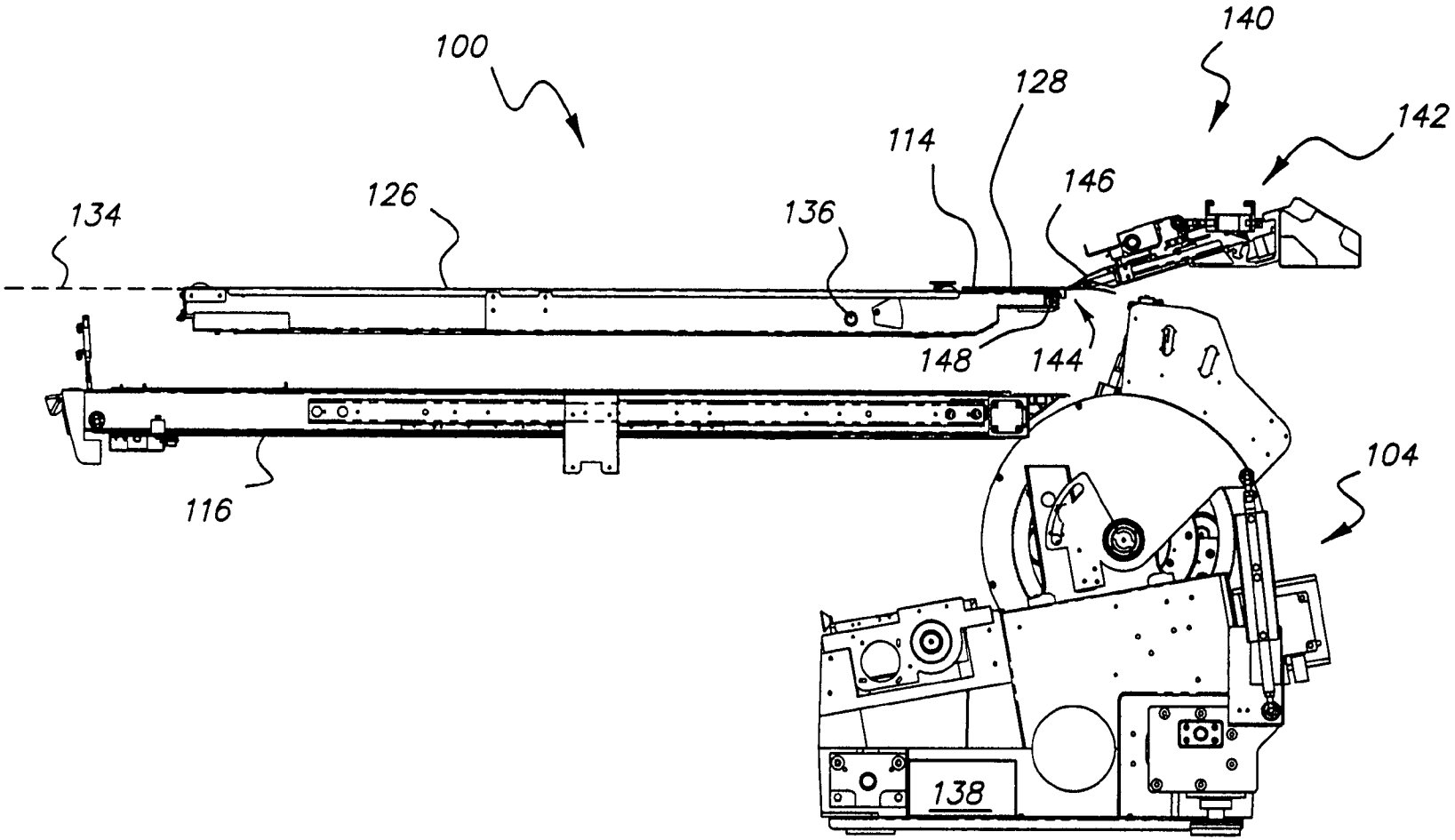
FIG. 3 is a second side view of a preferred embodiment of the imaging and punching system of the invention.

In one preferred embodiment shown the movable first end 128 of the imaged media support 126 is moved about a pivot point 136 from a first position 132 to the second position 134, shown in FIG. 3, proximate the punching system 140. In other embodiments of the present invention, the first end 128 may move back and forth between first position 132 and second position 134 along any suitable path including, but not limited to curved paths (e.g. circular, elliptical, parabolic, etc), liner paths and combined curved and linear paths. The imaged media support 126 could be articulated with the first end part of one of a plurality of sections or parts of the transfer system. The transfer assembly allows the punching system 140 to be part of the same system as the imaging system 104 which can result in more accurate punching and less damage to the plates which are large and fragile, and prone to damage, especially after imaging. Damage to the plates is not only expensive, since the plate cannot be re-imaged and must be discarded but also very time consuming since most damaged plates are not identified until the press starts printing.

A position and location of the imaged media plate 114 can be determined by one or more sensors (not shown), such as an optical sensor for optically determining at least one point of at least three points along two edges of the imaged media plate 114.These sensors can be included in the system as needed to assist the other registration components. Other sensors such as a touch probe, a magnetic probe, or a capacitance probe could also be used. The registration components act, along with various sensors in conjunction with a controller, can act as a positioning device for adjusting the position of the imaged media with respect to the surface in a perforation device, wherein the perforation device is further operable for forming a perforation in the imaged media in a predetermined, aligned relationship with the at least three points located on the at least two edges. This positioning device can include any of a push bar, registration pins, sensors or readers, cameras, vacuum cups, a vacuum chuck (grooves in a bar fed by a vacuum), air cylinders pushing the plate edge, air cylinders pulling the plate edge, belts with fingers to push the plate, air, rollers to convey the plate, an incline (gravity), leadscrew (s) for the pins, all types of motors including linear induction motors, and other devices. The system can also move the punches and punch registration pins toward a stationary plate 110 or imaged media 114 rather then moving the plate itself.

Figure 2:
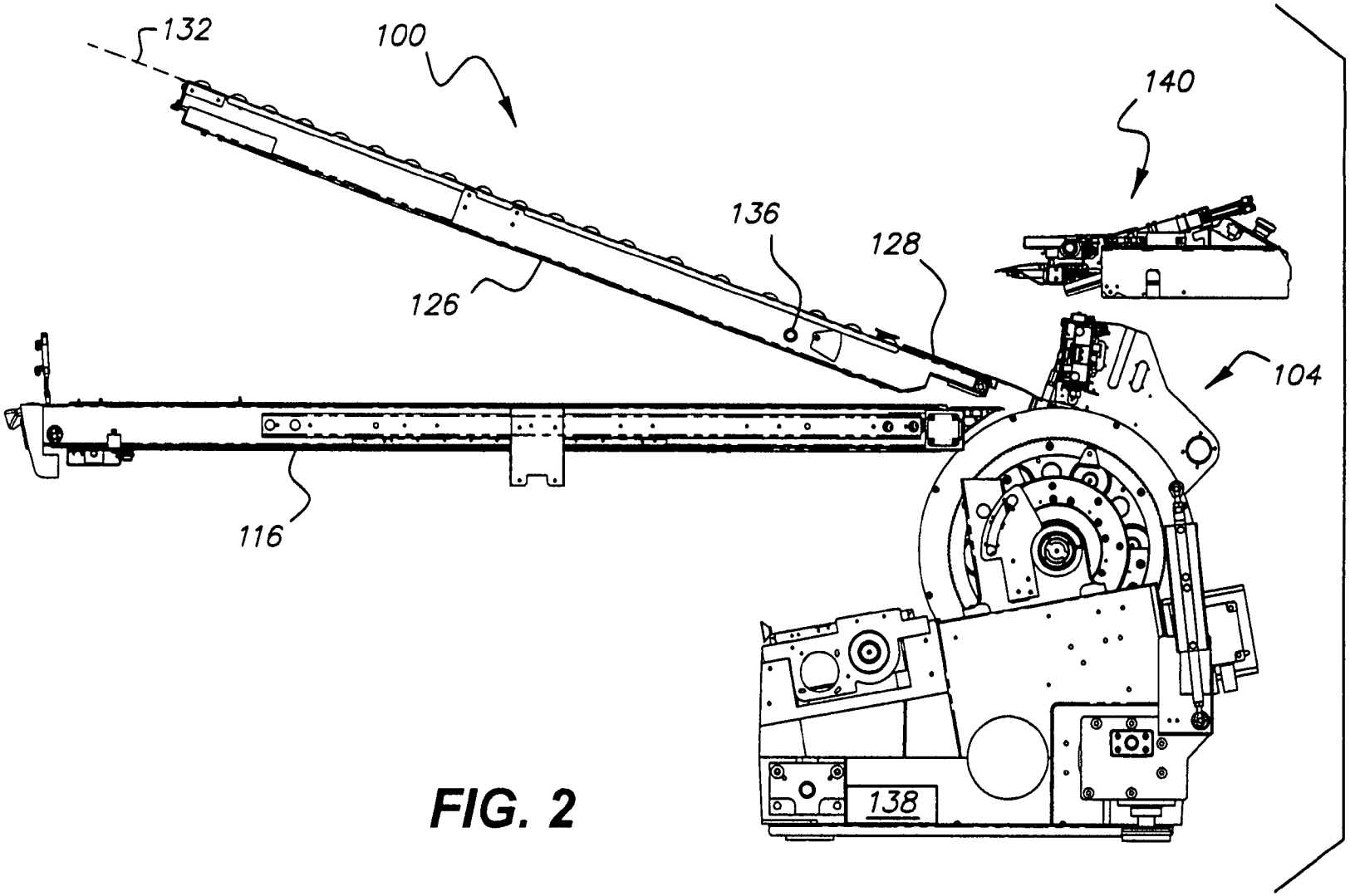
FIG. 2 is a side view of a preferred embodiment of the imaging and punching system of the invention.

The imaging and punching system 100 also helps assure that the position of the plate will be easily controlled and initialized during each step of the imaging and punching process since the same imaged media support 126 is used to both unload imaged media 114 as is used to transfer that imaged media 114 to the punching system 140 as shown in FIG. 2 and FIG. 3. Thus, the apparatus and associated method of the present invention does not typically require a new set up and exerts total control including, if desired, a single controller 138, including software to control all components and their interactions. Theses can be located in the punching system, as indicated figuratively by box 138, or in others system component or in a separate controller, such as a computer. Image media placement and system thermal control are two important control features that the imaging and punching system 100 can provide.

The thermal control feature will be discussed in further detail below. The imaging and punching system 100 can result in a compact and reliable system that can handle multiple plates and can image and punch simultaneously. The punching system 140, as shown in FIG. 3, includes a perforation assembly 142 proximate the imaged media support 126. The movable first end 128 now defines a punch clearance 144. The perforation assembly 142 includes at least one perforation device 146 for perforating the imaged media 114 in a punch area 148 (shown in FIG. 4), and a registration bar 150, which includes a punch platen, proximate the punch clearance 144.

Figure 4:
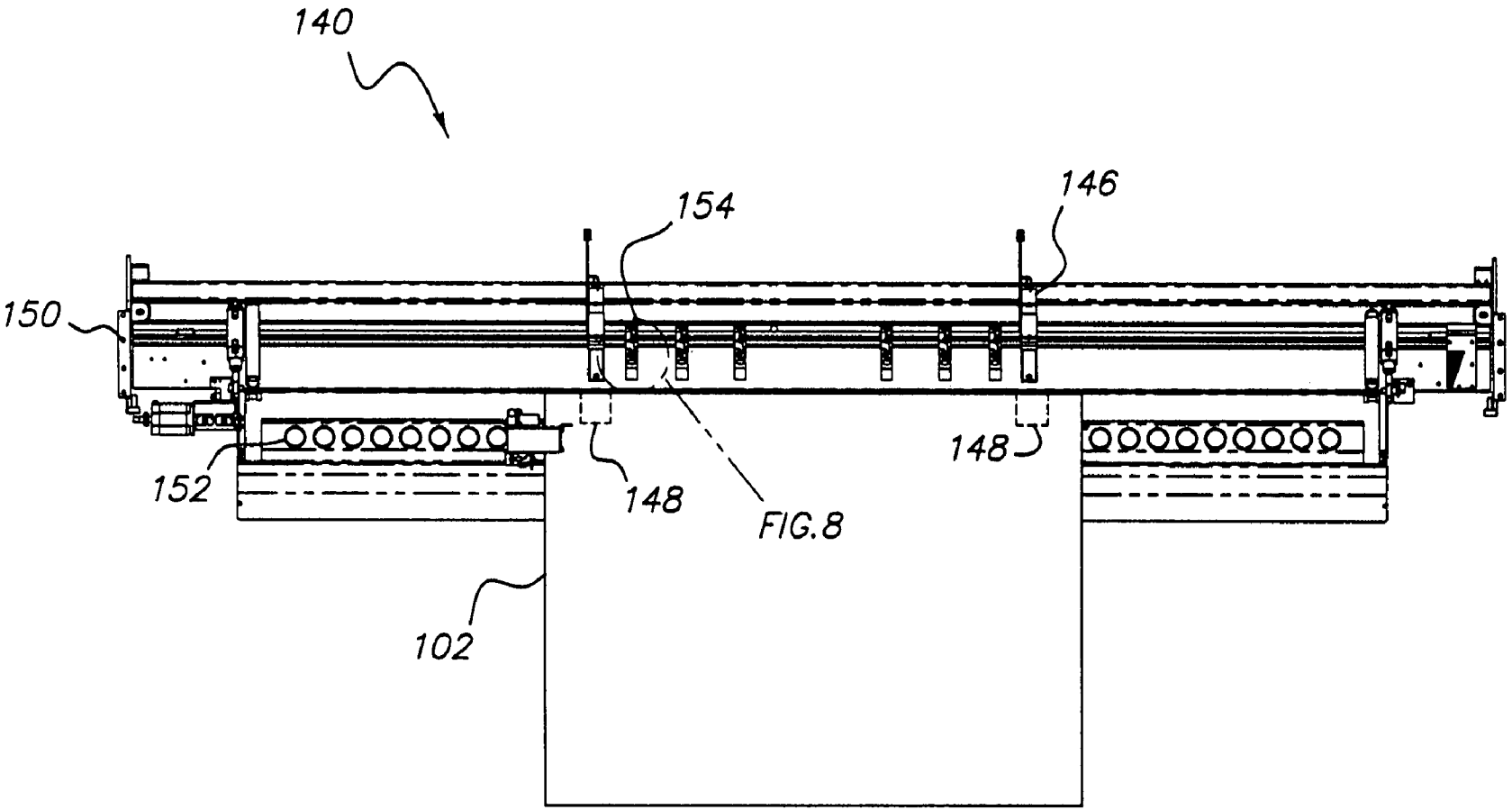
FIG. 4 is a top view of a preferred embodiment of the imaging and punching system of the invention.

A schematic of a portion of this preferred embodiment of the imaging and punching system 100 is shown in FIG. 4. The imaged media 114 moves into the punching system 140 after imaging. The punched holes are customized for each individual customer. The punched holes are typically configured in accordance with the registration features of a printing plate press cylinder onto which the plate is to be mounted. The punching system 140 includes the following major components. The registration bar 150, which includes the surface for punching, referred to as the punch-platen, and a plurality of vacuum orifices or apertures 152 that control the imaged media 114 and moves it to one or more punch registration pins 154. These can be contained in what is sometimes referred to as a vacuum cup, such that each vacuum cup contains an orifice so when a small plate which does not cover many of the cups, would allow the orifices to limit the vacuum loss from the uncovered cups so the overall vacuum is maintained high without the requirement for an excessively large vacuum source.

The registration bar 150, in a preferred embodiment, moves on air bearings via a plurality of air apertures 155 (shown in FIG. 5) to reduce friction but other bearings or means of reducing friction could be employed. In the preferred embodiment of the punching system, a punch bar 156, also referred to as a punch extrusion bar 156. The punch bar 156 has registration features and punches arranged closely to the leading edge of the imaged media 114. The registration bar 150 supports imaged media 114 such that the leading edge or first edge of media 114 extends only a small distance beyond the bar to minimize distortion in imaged media 114 during the registration and punching processes. The registration bar 150 assists in holding the imaged media 114 flat for accurate spacing when punching holes, which are often far apart from one another.

The registration pins 154 or a plurality of registration members are operable for aligning the first edge of at least two edges of the imaged media 114. The first set, a pair in this embodiment, of registration pins can be selected from the plurality of registration members 164 in accordance with at one or more factors that can include a size of the imaged media.

Additionally, the set of registration members 164 can be selected to substantially correspond to a set of registration member located on image recording member 108 which were used to align the recordable media during the forming of image 112 on the recordable media to for the imaged media 114. The spacing and location of the selected registration members 164 in relation to the first edge of the imaged media can be selected to correspond to the spacing and location of the registration pins used to align the recordable media on member 108 when image 112 was recorded to form image media 114. The registration members 164 can be selected to contact two of three points associated with two of the edges of imaged media 114, the three points associated with the two edges being determined before or during the recording of image 112 to form image media 114.

Figure 5:
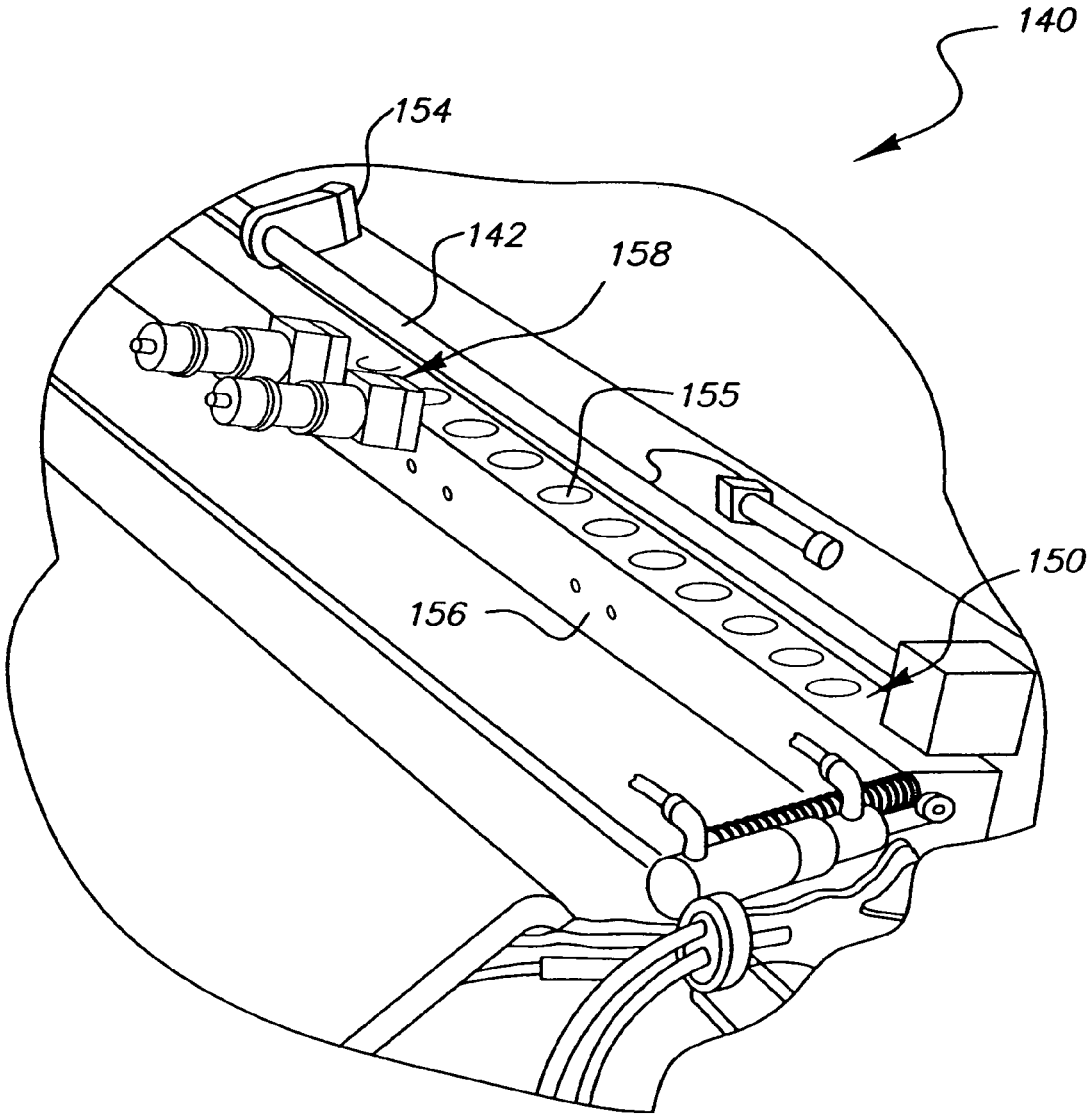
FIG. 5 is a perspective top view of a portion of the imaging and punching system of the invention.

A partial top view of a portion of a preferred embodiment is shown in FIG. 5. The punching system 140 shown includes a punch bar 156 in this embodiment. Also shown is the perforation assembly 142, mounted to the punch bar 156, including one or more punches 158 and the punch registration pins 154. The punch bar 156 is hollow to allow the punch debris, such as punch chips from the punches, to fall into the punch bar 156 and be removed by vacuum as described in the co pending application Ser. No. 11/xxx,xxx filed on the same date by the applicant.

Figure 6:
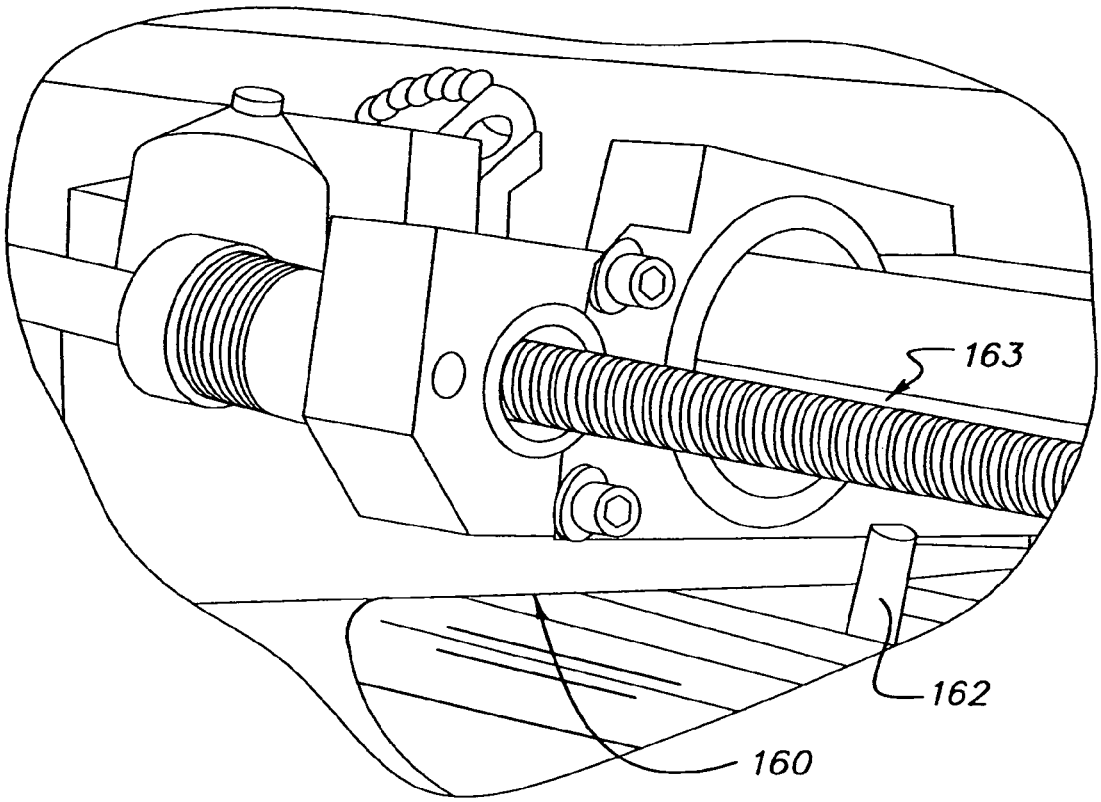
FIG. 6 is a perspective side view of a portion of the imaging and punching system of the invention.

FIG. 6 shows a top side view of a portion of the punching system 140 including the side registration pin 162, an edge 160 of the imaged media 114 and a side registration pin 162 to register the subscan side of the plate. The side registration pin 162 in a preferred embodiment has a flat face that can rotate slightly to conform to the edge angle of imaged media 114. This rotating capability allows the side registration pin 162 to present a flat supporting face to the imaged media 114 to minimize contact stress and prevent distortion of the media edge. The side registration pin 162 moves on a screw device 163 to move the plate into the correct side position.

Figure 7:
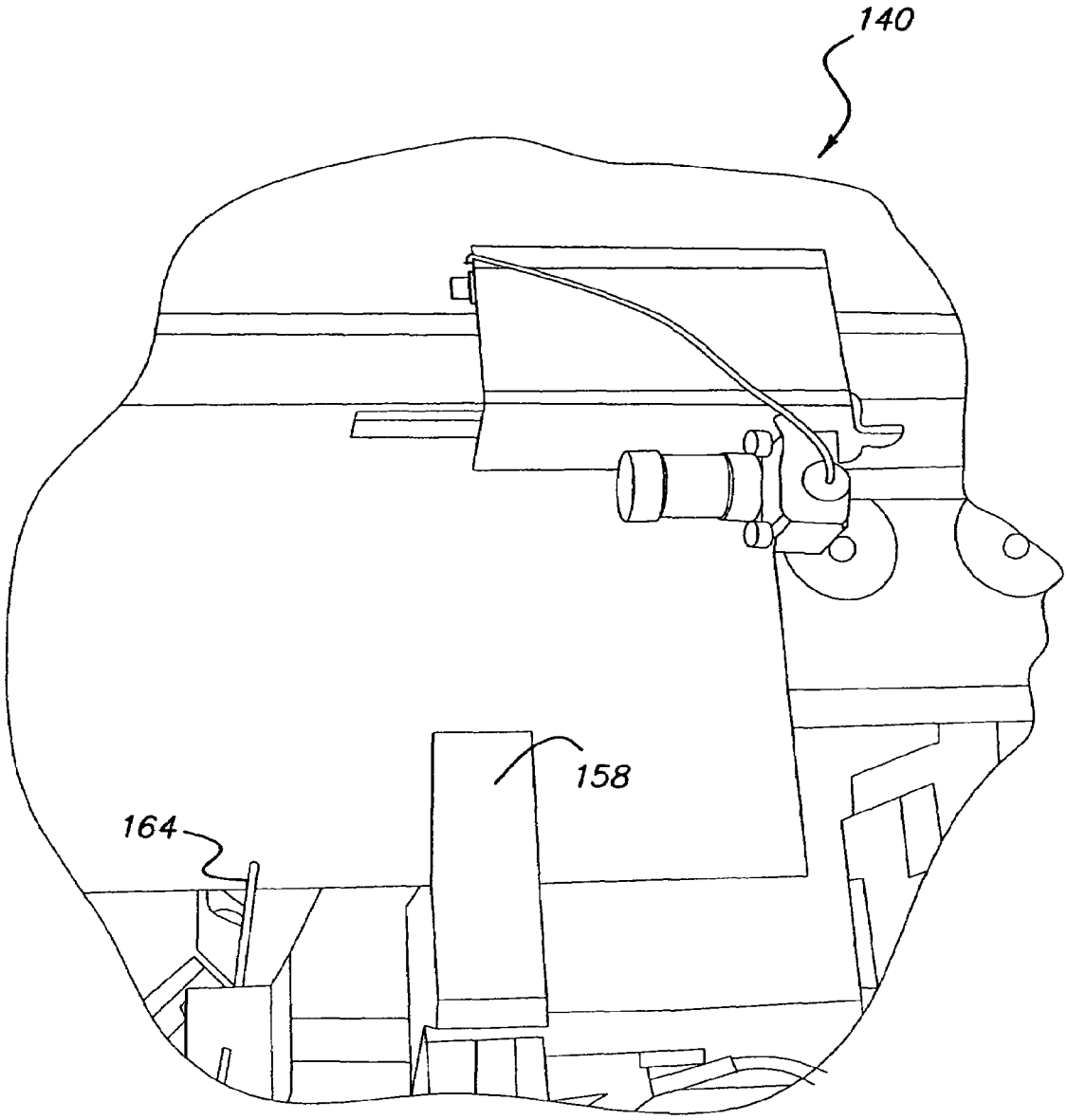
FIG. 7 is a perspective top view of a portion of the imaging and punching system of the invention.

FIG. 7 shows a top view of a portion of the punching system 140 including one, of a plurality of six in this embodiment, registration pin 164, sometimes referred to as the main, mainscan, lead, edge or leading edge rotating registration pin. In this embodiment there are two of these pins that the plate registers to in the mainscan direction. The registration pins 164 have a flat surface on them so they can be rotated to not contact the plate if not required. One is shown in a schematic enlargement in FIG. 8. In this embodiment one imaged media 114 will only use two of the six registration pins 164 that can be installed. The registration pins 164 can rotate when the imaged media 114 is held against the pins 164 and is moved laterally. Imaged media 114 can be moved laterally while the media is being pushed by side registration pin 162. This rotation helps prevent the imaged media from being scraped or scuffed on the pins, which can damage both the pins and the imaged media 114 and or lead to subsequent registration problems. The registration pins 164 of this embodiment also prevent too much load being applied to the side registration pin 162 which would lower the side pin 162 accuracy and thus affect the placement accuracy of the media 114.

Accurate placement is required to correctly punch the imaged media so that it can be correctly registered on press. Incorrectly punched registration features can result in the "offset" or mismatched color renditions that are sometimes seen poor print job. When the imaged media 114 include an electrically conductive portion, an electrical registration method as disclosed in U.S. Pat. No. 6,510,793 (which is herein incorporated by reference) can be used determine if media 114 is in properly in contact with the registration pins. Non-electrically conductive bearings such as ceramic ball bearings can be used to electrically isolate the registration pins from the surrounding structure to establish electrical paths with the imaged media 114.

The registration pins 164 are addressable and can rotate so that only a few out of the plurality of registration pins present, two in the preferred embodiment, contact the imaged media 114 at any one time. As previously discussed, the registration pins 164 also rotate to reduce frictional forces as the plate moves sideways against them. Lower frictional forces reduce the tendency to scuff material off the plate edge that may leave deposits on the pins and affect the registration accuracy of subsequently punched plates. The registration pins 164 preferably have a rotational surface that is cylindrical and is appropriately sized to reduce contact stress that can lead to deformation to the edge of the imaged media 114. Many rotational bearings known in the art can be used to allow the pins to rotate. Preloaded deep groove ball bearings are one such example of a suitable bearing since they are easily replaceable and their preloaded nature reduces bearing clearances that can adversely affect registration accuracy.

One or more electronic pressure regulators 168 can control air pressure supplied to air cylinders that can be used to move registration bar 150, also referred to as the punch vacuum bar 150. The cylinders can include push cylinders 170 to push the registration bar 150 towards the leading edge rotating registration pins164 based on an analog electrical input. This pressure can be calculated by the firmware 166 based on the size of the imaged media 114 and its position can be incorporated as well. The electronic pressure regulators 168 send the air to the air cylinders and move imaged media 114 to the pins. This allows the system 100 to handle heavy thick imaged media on the same machine as thin imaged media without distorting the thin imaged media with the amount of force that would be required to handle a thick imaged media.

The controller 138 containing the firmware 166 also allows coordination between the imaged media 114 and the registration pins 162 and 164 to establish proper registration. The firmware 166 can also control the thermal measuring and collection of thermal data from various assemblies and components such as the image support member 108, registration bar 150, and a movement device for side registration pin 164. The movement device can include a punch screw device and corrections in the placement of the imaged media 114 can be made to compensate for thermal variations that may if for example, the plate, punch bar, or screw device grow thermally during the imaging and punching steps. Fans can be also used to keep the punch temperature as close to the drum temperature as possible to help reduce thermal differences as further described in a co-pending application Ser. No. 11/xxx,xxx filed by the Applicant.

Figure 8:
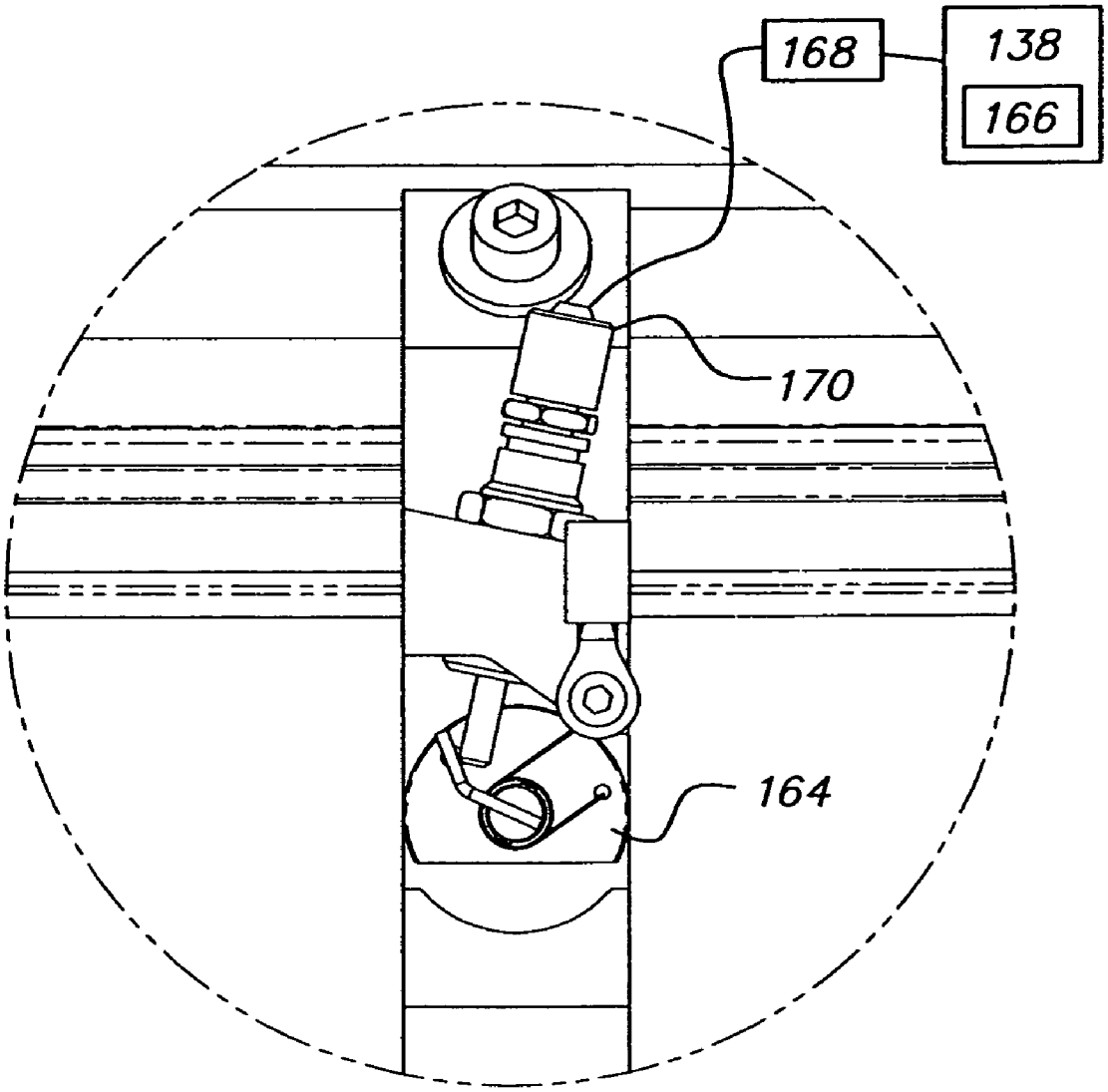
FIG. 8 is an exploded, schematic of a portion of the imaging and punching system.

The partially cylindrical registration pins 164 with a flat side, as shown on FIG. 8, the pins can be rotated to present the flat or cylindrical surface to the edge160. If the pin is rotated so the flat side is facing the imaged media 114, then the imaged media 114 will not register to that pin because that pin will be further away from the edge compared to any pin that has not rotated. In one preferred embodiment only two pins 164 will have their round side facing the edge 160 and therefore the edge 160 will abut only those two pins. The pin diameters are large so that the contact area with the edge 160 is high enough to reduce edge distortions from the contact force. Another advantage of the round pin is that it can rotate if the imaged media 114 tries to slide in the subscan direction, which can happen when the imaged media 114 is being pushed sideways (subscan direction) by the subscan registration pin 164 (this side registration pin is described in further detail later). Each registration pin 162 can be mounted in non-electrically conductive ceramic ball bearings that are preloaded in both axial and radial directions to make the assembly extremely accurate and repeatable. If pop-up pins were employed rather than rotating pins, the pin positional accuracy would typically be reduced since linear bearing may not necessarily provide the minimal clearances associated with preloaded ball bearings.

After the recordable media is imaged and unloaded from the image recording member 108 onto the imaged media support 126. The imaged media support 126 moves the imaged media 114 and positions it over the registration bar 150 with the plate's leading edge overhanging the punch bar 156. The imaged media 114 must overhang some amount in order to be able to enter the punches. An overhang of 2 inches will typically suffice, but the exact amount will be dependent n the punches used. The registration bar turns on and raises many vacuum orifices that pull the imaged media 114 down flat against the registration bar 150. Holding the imaged media 114 flat against the registration bar 150 helps to maintain the leading edge of the imaged media 114 to be in a flat orientation that mimics the conditions when the imaged media 114is installed on the printing press. If the plate was not held flat, the leading edge could be wavy when punched and the distance between the punched holes would be incorrectly positioned when the plate is installed on a press. Incorrectly punched holes can lead to registration errors on press.

The edge 160 is moved toward the registration pins 164 in the punch bar 156. The amount of air pressure necessary to move the imaged media 114 varies by size, and the force required to move a thick full size imaged media 114 (e.g. ~62"×82"×0.020") will typically be too high for a thin imaged media 114 (e.g. ~16"×20"×0.007") because it can damage the thinner edge. To prevent damage to the imaged media 114, the firmware 166 in the system 100 can calculate the mass of the imaged media 114 and its geometric center, and thereby calculates how much air pressure is required to each air cylinder in order to push the imaged media 114 towards the registration pins in the punch bar 156 without distorting the imaged media 114 once it contacts the pins. Similarly the firmware 166 calculates and directs an air source to supply the correct air pressure to the air cylinders (using electronically controlled variable air pressure regulators 168), to move the registration bar 156, on air bearings to minimize friction, and yet not cause the imaged media 114 to move too quickly toward the pins thus causing damage.

Once the plate edge contacts the two registration pins 164, this contact can be detected by passing an electrical signal through the plate from the pins 164 and is sometimes called mainscan registration. The third point of contact to assure accurate plate position is provided by the side registration pin 162, which is positioned by the screw device 163 in the subscan direction. This single subscan registration pin 162 moves to contact the side of the imaged media 114 and then pushes the plate to the correct position that can be a thermally compensated position based on the thermal readings discussed above. Distortion of the plate edge contacted by side registration pin 162 can be reduced or minimized due to the rotating action of the registration pins 164, the reduced friction associated with the air bearings, and the minimally calculated force applied by the air cylinders discussed above. The flat side of the side registration pin 162 is in contact with the imaged media 114 and thus the side pin 162 fully contacts the plate edge thereby further reducing contact stresses. Since the vacuum orifices are spaced closely together, there is very little plate length between the side registration pin 162 and the closest vacuum orifice, which results in very little distortion or buckling of the plate side edge. In one embodiment the side or subscan registration pin is mounted in all metal antifriction bearings so it easily pivots allowing the full flat to always contact the plate edge. These bearings are mounted in a non-electrically conductive housing but, alternately, the pin could use a metallic housing and non-electrically conductive ceramic bearings to allow for electrical registration.

If electrical registration is used, once the side registration pin 162 contacts the plate, this contact can be detected by passing an electrical signal from the pin 162 through the plate to the pins 164. Once the pin 162 stops in it's predetermined final place, electrical conductivity through the plate between all three pins is confirmed and then the plate is punched. The punches can be electrical or air actuated. They could be actuated in other ways such as hydraulic and mechanical methods. Once the imaged media 114 has been punched, the side registration pin 162 moves away from the plate's side edge so as not to damage it while the imaged media 114 is withdrawn to be ejected out of the system. The side registration pin 162 need not go to the pin's home position; it can just backs away slightly to a location adjacent the position of a subsequently loaded imaged media that of a similar size as the previous imaged media. The imaged media 114 can then be withdrawn out of the punches and away from the mainscan registration pins 164 to the same imaged media support 126. The imaged media support 126 moves the plate further away from the punch system in order to get it ready to be ejected out of the system to a plate processor or stacker, etc.

Another method for detecting contact conducts electricity through the plate between the three registration points to ensure they are in contact with the plate. This is monitored by the firmware 166 while punching is actually taking place, not just prior to punching, thus guaranteeing the imaged media plate 114 was punched correctly.

The present system can handle the punching of a range of Imaged media plates 114 from very heavy plates to light fragile plates on the same device. Normally the force to handle a heavy plate will distort a light plate beyond acceptable limits. This is handled in this system by using the firmware 166 to calculate the plate's mass and centre and then using this information to calculate the correct air pressure to apply to the air cylinders that push the plate towards the two front registration pins, and then applying that correct air pressure using electronically variable air pressure regulators. Alternately the cylinders could move the bar in other ways, such as to pull the bar if that was desired. The firmware also helps prevent distortions to the edge of the imaged media 114. This is accomplished in this system, as discussed above, using the three registration pins and allowing the registration pins to rotate, which prevents the plate edge from getting damaged when the plate is moved sideways against the pins. This allowable pin rotation also lowers the friction force the plate edge sees therefore lowering the distortion of the plate edge at the single side pin that is doing the pushing of the plate sideways. It also reduces the amount of plate material that will build up on the pin face (the plate will roll and not scrub on the pin surface).

This system can register a plate accurately so it can be punched in preparation for placing it on a printing press. The plate is pushed against 3 pins that conduct electrically through the plate to ensure they are in contact while the plate is punched. The force with which the plate is pushed against the pins is controlled to prevent distortions in the plate that would affect accuracy, and temperature measurements are taken and compensated for to ensure the punch hole is accurately placed.

The pins are allowed to rotate to prevent damage and smearing of the plate edge against the pin when the plate moves sideways against them. A flat on the otherwise round front registration pins allows them to be rotated to a position where they can not touch the plate edge if that pin is not required (this allows multiple registration pins to all be in line for different plate sizes and yet not interfere with each other). The plate edge is held flat against a bar by suction cups to: 1) keep the plate edge flat so the distance between the punches is as accurate as possible (if the plate is wavy then the plate distance is more than that between punches), and 2) minimizing the distance of the unsupported plate being pushed against the 2 front registration pins (keeping the column of plate as short as possible to prevent buckling and distortion), and 3) the suction cups are spaced close together so when the single side registration pin pushes on the plate's side edge, it also has a minimum of unsupported plate length (distance between the side pin and the nearest suction cup) to minimize plate buckling and plate distortion.

One preferred embodiment of this method of punching imaged media 114 is summarized below:

Punch Sequence for a "Single" Plate

The sequence of operation shown below is for punching of a single plate, meaning only one plate is imaged on the image recording member 108 (an imaging drum in this instance) at a time.

An un-imaged plate is picked from a plate supply, loaded onto the drum, and imaged to produce an imaged media plate 114. The imaged media plate 114 is unloaded off the drum and onto an imaged media support which has been moved into an inclined first position.. Once the imaged media support un-tilts and moves to a horizontal second position, the punch sequence starts.

1. The imaged media plate 114 is positioned to be handed off to the punch:
   - The imaged media 114 is shuffled sideways to approximately the centre of the imaged media support 126 (most imaged media plates 114 are punched while centered on the punch bar).
   - A deflector (not shown) tilts down to contact the imaged media support 126.
   - A traveler device (not shown) on the imaged media support 126 pushes the imaged media 114 up the deflector and over the punch registration bar 150
   - Control of the imaged media plate 114 is now transferred from imaged media support 126 to the registration bar 150:
   - The registration bar 150 turns on its vacuum orifices, raises them to control the imaged media plate 114, and lowers the vacuum orifices.
   - The imaged media support 126 releases the imaged media 114 plate.
2. The imaged media plate 114 is moved for registration with the leading edge rotating registration pins 164:
   - The firmware selects two pins required for that particular imaged media 114, and rotates them into a position wherein their cylindrical surfaces are presented towards the leading edge of the imaged media 114 (the unselected pins have a flat face presented towards the leading edge of the imaged media 114). The firmware calculates the force needed by the electronic pressure regulators to operate the registration bar push cylinders.
   - The cylinders move the registration bar until the imaged media 114 contacts the selected leading edge rotating registration pins 164. Contact is confirmed by the electrical registration system.
   - The imaged media plate 114 is then moved to a correct sub-scan position i.e. along the leading edge of the imaged media 114:
   - The side registration pin screw device is turned until the pin 164 is in the correct position. The position is determined by a calculation and firmware parameters that allows individual imaged media plates 114 to be matched to the positions of their punch locations and preferably takes into account any inaccuracies of the side registration pin's screw device and installation inaccuracies. The correct position of the imaged media plate 114 on the side registration pin 162 is confirmed by the electrical registration system.
   - For the first imaged media plate 114, the screw device starts from a Home position that is defined by a fixed course sensor in conjunction with a rotating fine sensor, but after that, the firmware keeps track of where the pin is positioned to so that it does not have to go to the Home position every time.
3. The imaged media plate 114 is then punched:
   - The custom electronic board capable of controlling the punch motors energizes the correct punches. The punches will be moved in subscan (i.e along the leading edge) or mainscan (i.e. perpendicular to the leading edge) direction if required (some punches can move laterally although most are fixed in position). If more than one punch must be energized, the firmware and control electronics can delay the start of each punch motor to avoid too much inrush current and monitors the sensor on each punch to know when they have finished punching. If the punch is a moveable punch and requires that it move from where it is, it will be moved by firmware 166.
4. Control of the imaged media plate 114 is then transferred to the imaged media support 126:
   - The side registration pin moves slightly away from the imaged media plate 114; the registration bar moves back to its starting position; the imaged media support 126 secures the imaged media plate 114; the registration bar releases the imaged media plate 114; and the imaged media support 126 traveler moves the imaged media plate 114 into the middle of the imaged media support 126 ready to be taken away to the processor.
5. The punched, imaged media plate 114 is ejected out of the machine to a Processor or Stacker etc.

The invention has been described in detail with particular reference to certain preferred embodiments thereof, but it will be understood that variations and modifications can be effected within the spirit and scope of the invention.

The invention claimed is:

1. A apparatus for imaging and perforating recordable media comprising:

an imaging system comprising an image recording device for forming an image on recordable media to form imaged media;

at least one perforation device having a punch movable into and out of a punch area to punch the imaged media; and a transfer assembly, including an imaged media support having a reference, said reference having a fixed relationship to said imaging system and said perforation device, the imaged media support being shuffled in a controlled manner, based on the reference, between a first position proximate the imaging system and a second position proximate the punch area.

2. The apparatus of claim 1, further comprising a positioning device for adjusting the position of the imaged media with respect to the imaged media support.

3. The apparatus of claim 2, the positioning device further comprising one or more registration pins.

4. The apparatus of claim 3, the positioning device further comprising one or more of the following: a push bar, registration pins, optical sensors or readers, vacuum cups, grooves in a bar fed by a vacuum, air cylinders pushing the plate edge, air cylinders pulling the plate edge, belts with fingers to push the plate, air, rollers driving the plate, an incline, leadscrew(s) for the pins, a motor, a sensors, and a camera and other devices.

5. The apparatus of claim 3, farther comprising a controller to control the one or more registration pins.

6. The apparatus of claim 3, wherein the one or more registration pins are adjacent the punch area.

7. The apparatus of claim 2, wherein the one or more registration pins comprises a plurality of registration pins, at least one registration pin having a hemispherical shape capable of rotating so that a rounded surface of a rotated registration pin contacts the imaged media.

8. The apparatus of claim 7, wherein the at least one registration pin is further capable of rotating such that only two of the plurality of registration pins contacts the imaged media.

9. The apparatus of claim 1, further comprising a controller to control the movement of the transfer assembly.

10. The apparatus of claim 1, further comprising a controller to control a placement of the imaged media in a predetermined manner.

11. The apparatus of claim 10, wherein the controller is further operable for controlling the punching system to form at least one perforation in the imaged media, wherein the predetermined manner aligns the at least one perforation with at least two edges of the imaged media.

12. The apparatus of claim 1, wherein the apparatus comprises a first registration system operable for defining at least three points on at least two edges of the recordable media, wherein the image is formed on the recordable media in aligned relationship with the at least three points.

13. The apparatus of claim 12, wherein the positioning device further comprises a second registration system for determining the at least three points on the imaged media, wherein the at least three points on the imaged media align based on information in a controller concerning the at least three points used to align the recordable media.

14. The apparatus of claim 13, wherein the first registration system comprises a first set of registration members located on the image recording member, wherein the first set of registration members is operable for aligning a first edge of the at least two edges.

15. The apparatus of claim 12, wherein the first registration system comprises an optical sensor for determining at least one point of the at least three points.

16. The apparatus of claim 15, wherein the first set of registration members is operable for determining two points of the at least three points on the recordable media, the apparatus further comprising a positioning device tat includes a second registration system for determining the two points on the imaged media.

17. The apparatus of claim 16, wherein the second registration system comprises a plurality of registration members, wherein a second set of registration members is selected from the plurality of registration members to determine the two points on the imaged media.

* * * * *

UNITED STATES PATENT AND TRADEMARK OFFICE

CERTIFICATE OF CORRECTION

PATENT NO. : 7,641,332 B2
APPLICATION NO. : 11/398295
DATED : January 5, 2010
INVENTOR(S) : Mark D. McGaire It is certified that error appears in the above-identified patent and that said Letters Patent is hereby corrected as shown below:

| Column | Line | |
|---|---|---|
| 10 | 44 | In Claim 1, delete "shuffled" and insert -- shuttled -- |
| 10 | 61 | In Claim 5, delete "farther" and insert -- further -- |
| 12 | 15 | In Claim 16, delete "tat" and insert -- that -- |

Signed and Sealed this

Twenty-first Day of September, 2010

David J. Kappos

David J. Kappos
*Director of the United States Patent and Trademark Office*